United States Patent [19]

Carlos

[11] 4,199,431

[45] Apr. 22, 1980

[54] OXIDATION OF PETROLATUMS IN THE PRESENCE OF HALIDE SALTS

[75] Inventor: Donald D. Carlos, Grayson, Ky.

[73] Assignee: Ashland Oil, Inc., Ashland, Ky.

[21] Appl. No.: 918,135

[22] Filed: Jun. 22, 1978

[51] Int. Cl.[2] ..... C07C 27/10; C10G 43/02

[52] U.S. Cl. ..... 208/3; 208/20.24

[58] Field of Search ..... 208/3, 24, 20

[56] References Cited

U.S. PATENT DOCUMENTS

| | | | |
|---|---|---|---|
| 2,050,772 | 8/1936 | Wait | 208/3 |
| 2,075,151 | 3/1937 | Wait | 208/3 |
| 2,119,940 | 6/1938 | Carr et al. | 208/3 |
| 2,146,018 | 2/1939 | Keunecke et al. | 208/3 |

*Primary Examiner*—Veronica O'Keefe

*Attorney, Agent, or Firm*—Van D. Harrison, Jr.

[57] ABSTRACT

Petrolatums are oxidized to high acid numbers by agitating a liquid petrolatum charge with the halide salt of an alkali metal, alkali earth metal or substituted ammonium halide while forcing gaseous air or oxygen through the liquid charge.

11 Claims, No Drawings

OXIDATION OF PETROLATUMS IN THE PRESENCE OF HALIDE SALTS

NATURE OF THE INVENTION

This invention relates to the oxidation of hydrocarbon waxes. More particularly, it is concerned with a process for oxidizing petrolatums to produce useful oxygenated products.

PRIOR ART

Oxidized petroleum fractions including petrolatums have, in the past, been employed as the source of saponifiable material in the production of lubricating greases and in the formulation of protective coatings. The oxidates employed for these purposes have been obtained by oxidizing selected petroleum fractions under controlled conditions such that the oxidation proceeds only to a limited extent.

Oxidation of petroleum fractions by the above described method has, associated with it, certain difficulties. Some petroleum fractions are not easily oxidized by the prior art processes and eventhough oxidizable, in some instances, require a preliminary induction period before the rate of oxidation becomes appreciable. Another problem associated with oxidizing petrolatums is the discoloration of the final wax product rendering it aesthetically unattractive for use in some formulations.

OBJECT OF THE INVENTION

One object of this invention is to provide an improved process for the oxidation of petrolatums. Another object of the invention is to provide a process for oxidizing petrolatums more easily than has heretofore been possible.

SUMMARY OF THE INVENTION

Briefly stated, this invention comprises a process for oxidizing petrolatums comprising blowing through a molten mixture of petrolatum, an oxidizing gas in the presence of a catalyst comprising the halide salt of an alkali metal, or an alkali earth metal, or an ammonium or substituted ammonium halide.

The oxidation is conducted under suitable conditions of gas-flow, pressure and temperature to oxidize the petrolatum to a predetermined acid number.

DESCRIPTION OF THE INVENTION

The alkali metal salts useful in this invention include the halide salts of lithium, sodium and potassium. A preferred alkali metal salt is sodium chloride. The alkali earth metal salts useful in this invention include the halide salts of barium, strontium, calcium and magnesium. A preferred salt is calcium chloride. The ammonium or substituted ammonium halide salts useful in this invention include ammonium chloride and ammonium bromide and primary, secondary and tertiary amine hydrochlorides. Preferred ammonium compounds are quaternary ammonium compounds such as dodecyltrimethylammonium chloride or tetramethylammonium chloride. The alkali metal, alkali earth metal or ammonium halide is added to the hydrocarbon fraction in a concentration of between 0.05 and 2 parts by weight per 100 parts of hydrocarbon. A small amount of water can be added to the reaction mixture. The preferred amount of water is that amount which will result in a saturated solution of the halide salt in the water.

The preferred hydrocarbon waxes, oxidized by the method of this invention, are the so called "petrolatums" of the refining art. These petrolatums are saturated paraffinic hydrocarbons having an average of 40 to 100 carbon atoms per molecule and a nitrogen content of less than 80 parts per million.

Ordinarily, the process will be carried out as a batch process. The technique of air oxidation of petrolatum is well known to those skilled in the art. Air or another oxidizing gas is forced through the reaction mixture of petrolatum and catalyst at a rate of between 0.5 and 10 liters (measured at 25° C., and 1 atmosphere) per liter of petrolatum per minute at a temperature of between 150° and 180° C. An oxidation pressure of between 50 and 400 psig 4.4 to 28.2 atmospheres in the reactor is preferred). Ordinarily, the temperature will rise as the oxidation proceeds so that only minimal heat may be required for the oxidation. The process is discontinued when a desired acid number is reached. The term "acid number" is defined to mean the number of milligrams of potassium hydroxide required to neutralize 1 gram of sample.

EXAMPLE 1

Oxidations of petrolatum were conducted in laboratory tests using a 1 liter Parr bomb. In each test the reactor charge amounted to approximately 500 cc of petrolatum. The petrolatum tested was a "pilot plant petrolatum" having a nitrogen concentration of 76 ppm. To the petrolatum was added the weight of the catalyst as shown in the accompanying table. The reaction conditions were approximately three hours for each run at a temperature of approximately 320° F., (160° C.), a pressure of 200 psig (14.6 atmosphere), and an air input rate of 3.8 liters of air (measured at 25° C. and 1 atmosphere) per liter of reactor charge per minute. When the temperature of the reaction mixture reached 320° F. (160° C.), the time elapsing from that point until oxidation began was measured. This period of time is designated as the induction time. The beginning of oxidation was arbitratarily set as that point at which the oxygen content of effluent air from the bomb dropped to 19.5%. Acid number determinations were made at the end of each three-hour run. The results are shown in Table I.

Table I

Batch Air Oxidation of Petrolatum

| Run No. | Catalyst Composition | Parts Catalyst Per Part HC | Acid Number | Comments |
|---|---|---|---|---|
| 1 | NaCl | 1/99* | 34.5 | ½ hour induction period |
| 2 | NaCl | 2/98 | 30.1 | |
| 3 | NaCl | 0.5/99.5 | 35.3 | |
| 4 | NaCl | 0.1/99.9 | 29.1 | Long induction period |
| 5 | $CaCl_2$ | 1/99* | 32.8 | No induction period |

*plus 12 cc of $H_2O$ per total charge.

EXAMPLE 2

This example shows the effect of water concentration on oxidation. A slack wax (similar to a petrolatum) having a nitrogen concentration of approximately 3 ppm was oxidized using as a catalyst, sodium chloride in water at various ratios and at several concentrations of sodium chloride in the total reaction mixture. Results are tabulated in Table II. The oxidation conditions (rate of air flow, oxidation pressure and oxidation temperature) were the same as in Example 1.

Table II

| Run No. | Promoter/% By Weight | Water/ NaCl ratio | Acid Number | Induction Time (Min.) |
|---|---|---|---|---|
| | Batch Air Oxidation of 250 N-IR-Ls Slack Wax for 3 Hours | | | |
| 1 | NaCl/0.5 Water/none | 0 | 26.7 | 60 |
| 2 | NaCl/0.5 Water/0.625 | 1.25 | 42.2 | 2 |
| 3 | NaCl/0.5 Water/1.25 | 2.5 | 40.6 | 4 |
| 4 | NaCl/0.5 Water/2.5 | 5 | 47.4 | 10 |
| 5 | NaCl/0.5 Water/5.0 | 10 | 38.3 | 38 |
| 6 | NaCl/0.05 Water/5.0 | 100 | 26.7 | 44 |
| 7 | NaCl/0.05 Water/2.5 | 50 | 36.1 | 37 |
| 8 | NaCl/1.0 | 2.5 | 46.4 | 6 |
| 9 | NaCl/2.0 Water/5.0 | 2.5 | 42.8 | 10 |

From Runs 1–5 in Table II, it is readily apparent that the greatest acid number and lowest induction times occur when the ratio of water to NaCl is between 1 and 5. The actual concentration of NaCl in the total reaction mixture does not appear quite as critical. As can be seen from Runs 3, 8 and 9, concentration of 0.5 to 2 parts per 100 parts of reaction mixture give reasonable acid numbers with minimum induction periods.

EXAMPLE 3

Under similar conditions of pressure, temperature and time, a petrolatum stock was oxidized with air using dodecyltrimethylammonium chloride. Test runs were conducted at a catalyst-to-petrolatum ratio of 1 to 99, and 0.5 to 99.5 parts by weight. The acid numbers obtained were 19.8 and 28.1. In each case, initiation of oxidation was almost immediate. In another test, using tetramethylammonium chloride in a ratio of 1 part to 99 parts of petrolatum, an acid number of 29.6 was obtained and no preliminary induction period was required.

I claim:

1. A process for oxidizing a petrolatum having an average of 20 to 100 carbon atoms per molecule comprising blowing an oxidizing gas through a liquid mass of said petrolatum at a temperature of between about 150° and about 180° C. in contact with water and a catalytic amount of a halide salt selected from the group consisting of alkali metal halides, alkali earth metal halides, ammonium halides, N-substituted ammonium halides and mixtures thereof the ratio by weight of water to halide salt being between about 1 and about 5.

2. The process of claim 1 wherein said halide salt is sodium chloride.

3. The process of claim 1 wherein said halide salt is calcium chloride.

4. The process of claim 1 wherein said halide salt is dodecyltrimethylammonium chloride.

5. The process of claim 1 wherein said halide salt is tetramethylammonium chloride.

6. The process of claim 1 wherein the rate of air injection is between about 0.5 and about 10 liters (measured at 25° C. and 1 atmosphere) per liter of liquid wax.

7. The process of claim 1 wherein the oxidation is conducted at a pressure of between about 4.4 and about 28.2 atmospheres.

8. The process of claim 1 wherein the concentration of halide salt in the reaction mixture of petrolatum, halide salt and water is between about 0.5 to 2 parts by weight per 100 parts of reaction mixture.

9. The process of claim 1 wherein said halide salt is sodium chloride, the ratio of air injection is between about 0.5 and about 10 liter per liter of petrolatum, and the oxidation pressure is between about 4.4 and about 28.2 atmospheres.

10. The oxidized product produced by the process of claim 1.

11. The oxidized product produced by the process of claim 7.

* * * * *